US011072875B2

(12) United States Patent
Jacobson

(10) Patent No.: US 11,072,875 B2
(45) **Date of Patent: *Jul. 27, 2021**

(54) MULTISTRAND BUTTON RETENTION SYSTEM

(71) Applicant: Howard Jacobson, Birmingham, MI (US)

(72) Inventor: Howard Jacobson, Birmingham, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/781,263

(22) PCT Filed: Dec. 3, 2015

(86) PCT No.: PCT/US2015/063722

§ 371 (c)(1),
(2) Date: Jun. 4, 2018

(87) PCT Pub. No.: WO2017/095414

PCT Pub. Date: Jun. 8, 2017

(65) Prior Publication Data

US 2018/0355533 A1 Dec. 13, 2018

(51) Int. Cl.

| | |
|---|---|
| ***D05B 97/10*** | (2006.01) |
| ***D05B 85/00*** | (2006.01) |
| ***A44B 1/20*** | (2006.01) |

(52) U.S. Cl.

CPC ..... *D05B 97/10* (2013.01); *A44B 1/20* (2013.01); *D05B 85/00* (2013.01)

(58) Field of Classification Search

CPC ..... D05B 97/10; D05B 85/00; D05B 3/14; A44B 1/20; A44B 1/32; A61F 2/08; A61B 17/04

See application file for complete search history.

(56) References Cited

U.S. PATENT DOCUMENTS

| | | | |
|---|---|---|---|
| 351,683 | A | 10/1886 | Arnold |
| 395,522 | A | 1/1889 | Stone |
| 1,633,614 | A | 6/1927 | Sibbald et al. |
| 1,674,544 | A | 6/1928 | De Hertelendy |
| 1,951,516 | A | 3/1934 | Lyons |
| 2,239,028 | A | 4/1941 | Baker et al. |

(Continued)

FOREIGN PATENT DOCUMENTS

| | | | |
|---|---|---|---|
| CN | 201718612 | U | 1/2011 |
| CN | 204541033 | U | 8/2015 |

(Continued)

OTHER PUBLICATIONS

International Search Report dated Sep. 2, 2016 for International Application No. PCT/US2015/063722 filed Dec. 3, 2015.

*Primary Examiner* — Ismael Izaguirre

(74) *Attorney, Agent, or Firm* — Blue Filament Law PLLC

(57) ABSTRACT

A sewing system for attaching or re-attaching buttons is provided. Embodiments of the sewing system have a single- or multi-strand thread of one to ten woven threads, the threads having a length of at least one inch with one needle pre-attached, terminating in free strands, an opposing end securement, or two needles attached to opposing ends of the thread. The appearance of a professionally sewn button is provided while eliminating the need to make multiple passes through the button holes and fabric.

22 Claims, 2 Drawing Sheets

(56) References Cited

U.S. PATENT DOCUMENTS

| | | | | | |
|---|---|---|---|---|---|
| 2,605,943 | A | * | 8/1952 | Hoefle | A44B 1/185 223/102 |
| 3,368,343 | A | | 2/1968 | Crook et al. | |
| 3,754,304 | A | * | 8/1973 | Modrey | A44B 1/185 24/114.7 |
| 3,857,484 | A | | 12/1974 | Thyen | |
| 4,296,698 | A | * | 10/1981 | Davidson | A41H 37/005 112/110 |
| 4,773,343 | A | | 9/1988 | Riche | |
| 4,823,948 | A | | 4/1989 | Bonar | |
| 5,428,872 | A | | 7/1995 | Papazian et al. | |
| 5,518,814 | A | | 5/1996 | Bonigk | |
| 5,671,507 | A | * | 9/1997 | Deschenes | A44B 1/185 24/114.7 |
| 6,319,547 | B1 | | 11/2001 | Li | |
| 6,702,162 | B1 | * | 3/2004 | Hassid | A41H 37/008 223/1 |
| 9,795,191 | B2 | * | 10/2017 | Jacobson | A41F 1/004 |

FOREIGN PATENT DOCUMENTS

| | | | |
|---|---|---|---|
| DE | 4223853 | A1 | 1/1994 |
| JP | H11128581 | A | 5/1999 |
| JP | 2000290821 | A | 10/2000 |
| JP | 3114990 | U | 11/2005 |

* cited by examiner

MULTISTRAND BUTTON RETENTION SYSTEM

FIELD OF THE INVENTION

The present invention in general relates to sewing, and in particular to a single- or, multi-strand having a needle pre-attached, or a button with a pre-attached needle; and used for the attachment or reattachment of a button.

BACKGROUND OF THE INVENTION

Buttons are among the most common fasteners for garments such as shirts, dresses, skirts, pants, etc. Buttons are generally attached to a garment with a thin strand of thread that is looped through the holes in the button multiple times in a repeated fashion. The repeated looping of the strand acts together to form the equivalent of a reinforced thicker single strand. During manufacturing of garments, buttons are attached with machines that can rapidly sew the strand through the button's holes multiple times. However, buttons are prone to tearing away from garments through use over time, as well as breakage. The process of attachment of a new button or reattaching a button is quite laborious and time consuming. First, the thin thread must be put through the eye of a needle, and then the needle needs to pass through the button hole and garment multiple times. For example, a button with four attachment holes connected with the thin strand repeated four times would require sixteen needle passes. The difficulty of sewing on buttons dissuades many people from trying to attach new button, or reattach their separated buttons.

Thus, there exists a need for a button attachment system and method that is easy to use, and reduces the amount of time and effort required for attachment, or the reattachment of a button. There further exists a need to provide a button retention repair that has the appearance of a tailored button repair.

SUMMARY OF THE INVENTION

A sewing system is provided for reattaching a button. A single or multi-strand thread of one to ten joined threads is provided with one needle pre-attached to one end, while the other end terminates in free strands, in a securement, or two needles pre-attached to opposing ends of the thread. The thread is typically from one to forty eight inches in length. In some embodiments there are synchs of the threads intermediate along the length thereof.

A sewing system is also provided in which the threads are a woven single thread, or a multi-strand thread. In a specific embodiment, a sewing needle is pre-attached to one end of the thread, and a securement is present at the opposing end. An article is provided that has a button affixed to the article fabric with a professionally sewn appearance and strength while eliminating the need for multiple passes through the fabric and button.

DESCRIPTION OF THE PREFERRED EMBODIMENTS

Figure 1A:
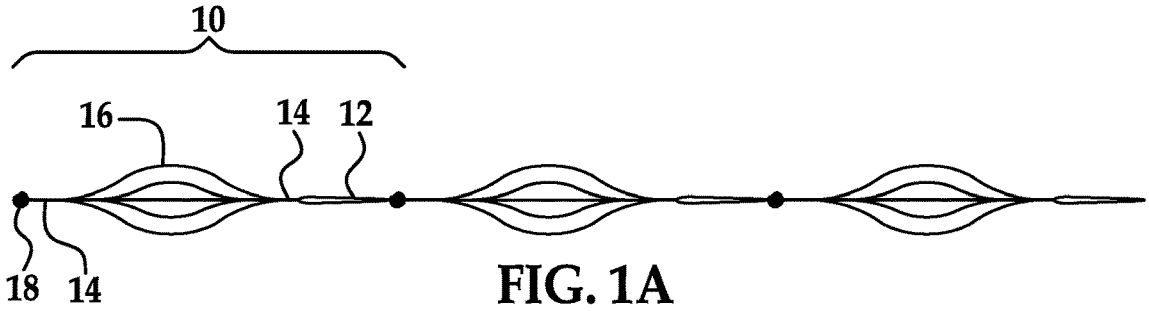
FIGS. 1A, 1B, and 1C are views of a multi-strand pre-attached needle used for reattachment of buttons according to embodiments of the invention.

An inventive sewing system has utility in reattaching a button. Embodiments of the inventive sewing system may have a single or multi-strand thread of one to ten joined threads, the threads having a length of at least one inch with one needle pre-attached and a securement at the opposing thread end, or two needles attached to opposing ends of the thread. In a certain embodiments, the thread may be from one to forty eight inches in length. In a specific embodiment the thread may be longer than forty eight inches. In embodiments of the inventive sewing system the thread may be a woven single thread, or a multi-strand thread. In a specific embodiment a sewing needle is pre attached to one end of the thread, and a securement of an end knot is at the opposing end. It is appreciated that securements of threads illustratively include a knot of the threads, an adhesive, a solidified polymer bead, fused synthetic fibers, a collet, or a combination thereof. While the fabric to which the present invention is typically used to secure a button is woven garment fabric, it is appreciated that the present invention is suitable for attachment of various fasteners to other types of fabrics such as industrial sheet materials of woven and unwoven forms, as well as fabrics that are not intended for wearing.

It is to be understood that in instances where a range of values are provided that the range is intended to encompass not only the end point values of the range but also intermediate values of the range as explicitly being included within the range and varying by the last significant figure of the range. By way of example, a recited range of from 1 to 4 is intended to include 1-2, 1-3, 2-4, 3-4, and 1-4.

The terms "reattaching" and "reattachment" as used herein are used synonymously with "attaching" and "attachment", respectively; and intended to encompass the replacement of a damaged or lost button from a garment, as well as the addition of a new button to a garment.

The term "joined" is used herein to connote woven, crimped, or otherwise spatially controlled relative positioning of threads.

In certain embodiments of the inventive sewing system, the single or multi-strand threads (one to ten threads) are intertwined to form a knot or other form of securement where the securement at one end and sewing needle is pre-attached to the other end; or two needles are pre-attached to both ends; and in either case, the middle portion of the thread length is unwoven for at least 1 inch. The unwoven section is designed for securing the button and for providing the appearance of conventional separate multi-threads securing the button, while eliminating the need to make multiple passes through the button holes and garment fabric. The thickness of the threads is determined by the garment and the purpose for which the button is being used. For example, a button for securing pants may require thicker threads or more threads than a button for closing a shirt cuff.

The inventive sewing system uses sewing needles that are of standard sewing needle length or shorter and are straight or curved. The sewing needles are pre-attached to the woven thread ends by crimping, gluing, heat affixing, friction affixing, cinching, or standard threading and knotting. By way of example, friction affixation is routinely used with leather thong sewing needles having a split following end that friction retains the thong being conveyed through openings by the needle. In certain embodiments of the inventive sewing system, heat shrink wrap tubing may be used at the woven ends of the thread to create a rigid area to be used as a needle. Alternately, the woven ends of synthetic thermoplastic polymer woven threads are fused in a mold or otherwise drawn to create a rigid tip to be used as a needle.

In use, the inventive sewing system is pre-threaded through a button that has fallen from a garment fabric, in such a way that the needles merely have to be sewn through the fabric of a garment (or through any material that the user would want to affix the button). In the case when the needle is not pre-attached, the thread passes through a button hole at least once and the garment. In certain embodiments, the thread is passed through the garment at least twice from back side of fabric-button hole on front side of fabric to form a loop and knotted or otherwise secured on the other side of the fabric to affix the button.

With embodiments of the inventive sewing system the threading of a recovered button or replacement button may occur as follows for a configuration using two needles on a standard four button-hole button. It is appreciated that a button is in some embodiments has threads traversing therethrough before the button, which is pre-threaded, is attached to the garment fabric. In other inventive embodiments, the thread is drawn sequentially through fabric then through a standard button hole, through another button hole and back through the fabric in a repetitive, conventional manner to sew the button to the fabric. In one inventive process, a user starts by threading through from the back face of the button up through any of a four button hole-button. The user then conveys the needle and pre-attached threads downward from the top face of the button through a diagonally located button hole of the exemplary four-hole button. Next, the user conveys the needle and pre-attached threads upward through either of the adjacent button holes, and then the user threads downward through the remaining diagonally located button hole. Following the threading of the button, the button is ready to be affixed to the fabric, and the user inserts one or both needles through the desired fabric. Next, the user forms a knot with the two threading ends on the back side of the fabric relative to the affixed button. It is appreciated that knotting also readily occurs intermediate between the button back side and the front side of the fabric. With such knotting often accompanied by a wrapping of threads around those joining the button and fabric to create a reinforced standoff adapted to engage fabric defining a fabric aperture intended to receive the button. The knotting may be repeated until a desired button secureness is obtained. The user then removes the pre-attached needles.

Alternatively, for inventive sewing system embodiments with the single needle-securement the same process as above is performed except that the process starts by sewing through the fabric first, leaving some thread on the opposite side of the fabric from the back side the button that is being affixed, so the needle end of the thread and this end can be knotted following the threading of the button. It is appreciated that the button retention system is suitable for attachment of single hole buttons, as used for example on coats, two hole buttons, three hole buttons, as well as the four hole buttons described in the aforementioned exemplary usage.

Embodiments of the inventive sewing system may be deployed end to end (as shown in FIG. 1A), which allow the sewing system to be stored on a spool and also allows the sewing system to be dispensed in a similar way that thread or dental floss is dispensed. The needle ends made of metal, hardened shrink tubing or heat hardened polymer are partially pre-cut thereby allowing the user to separate portions to form a pointed end of a needle, or a noted-above, synthetic fiber thermoplastic thread is thermally formed into a needle tip directly thereby precluding the need to sever portions to expose a needle tip.

Embodiments of the sewing system may be pre-packaged with replacement buttons that would be pre-threaded with white and various other colored threads for immediate use. In specific embodiments the sewing system may be implemented with replacement buttons that are attached to a garment or supplied with the garment. Replacement buttons are supplied with a fabric or garment so that an exact color and size of a detached button may be replaced with a matching replacement. These ready to affix buttons could be used by individual button end users, dry cleaner/seamstress/tailoring establishments and shirt/fabric manufacturing companies in their clothing/production processes.

Figure 1B:
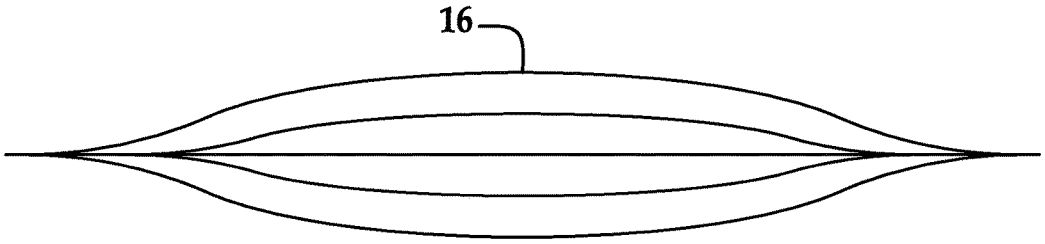
Figure 1C:
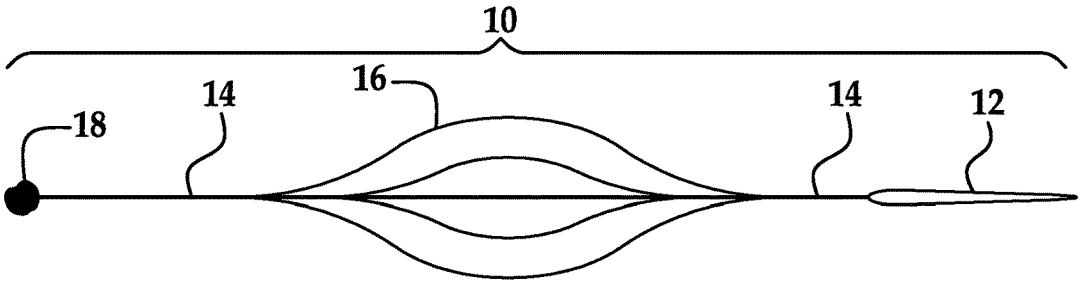

Referring now to the figures, FIGS. 1A, 1B, and 1C illustrate an embodiment of the inventive sewing system 10 with a single sewing needle 12 at one end and a knot termination 18 at a second end that secures a button to the back of a garment. Adjacent to both the needle 12 and knot termination 18 are segments of woven thread ends 14. The segments being equal to, or greater than zero inches in length, and in some embodiments is greater than $1/32^{nd}$ of an inch. Between the woven thread ends 14 is an unwoven section 16 of one to ten threads that is designed for securing a button and for providing the appearance of separate multi-threads securing the button, while eliminating the need to make multiple passes through the button holes and garment fabric. FIG. 1B is a detail view of the unwoven section 16 and shows five threads for securing a button.

Figure 2:
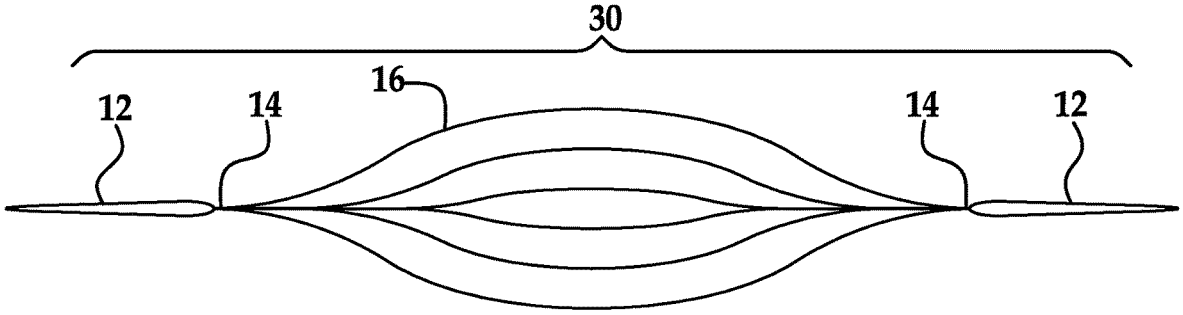
FIG. 2 is a view of a multi-strand thread pre-attached to sewing needles at both ends of the thread according to embodiments of the invention.

FIG. 2 is a view of an embodiment of the inventive sewing system 30 of the multi-strand thread pre-attached to sewing needles 12 at both ends of the thread according to embodiments of the invention.

Figure 3:
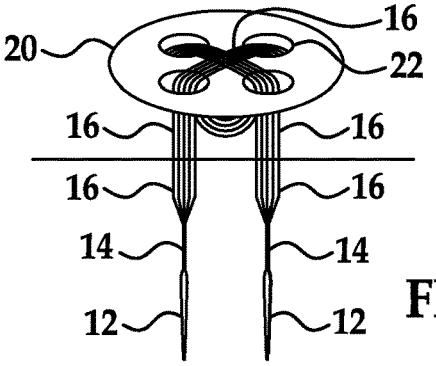
FIG. 3 is a top view of a button attached to a garment with multiple strands with the multi-strand pre-attached needle of FIGS. 1A-1C and FIG. 2.

FIG. 3 is a top view of a button 20 attached to a garment with multiple strands 16 with the multi-strand pre-attached needle (10, 30) of FIGS. 1A, 1B, 1C, and FIG. 2.

Figure 4:
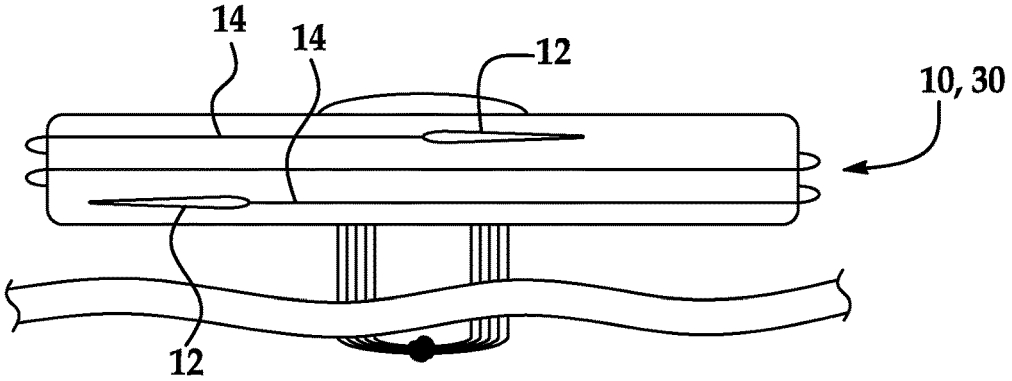
FIG. 4 is a side view of a replacement button retaining a multi-strand pre-attached needle or a dual needled multi-strand in accordance with embodiments of the invention.
Figure 5:
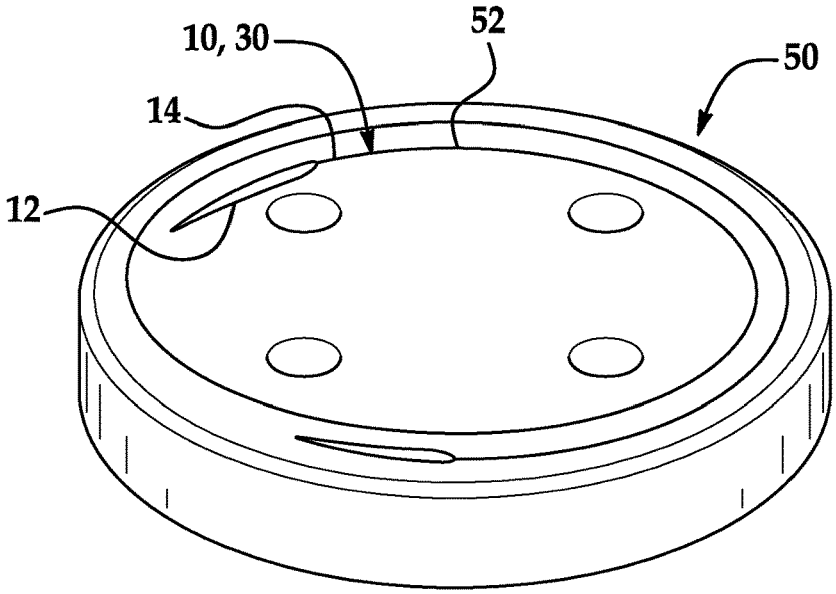
FIG. 5 is a bottom view of a replacement button with a circular bottom face recess for retaining a multi-strand pre-attached needle or a dual needled multi-strand in accordance with embodiments of the invention.
Figure 6:
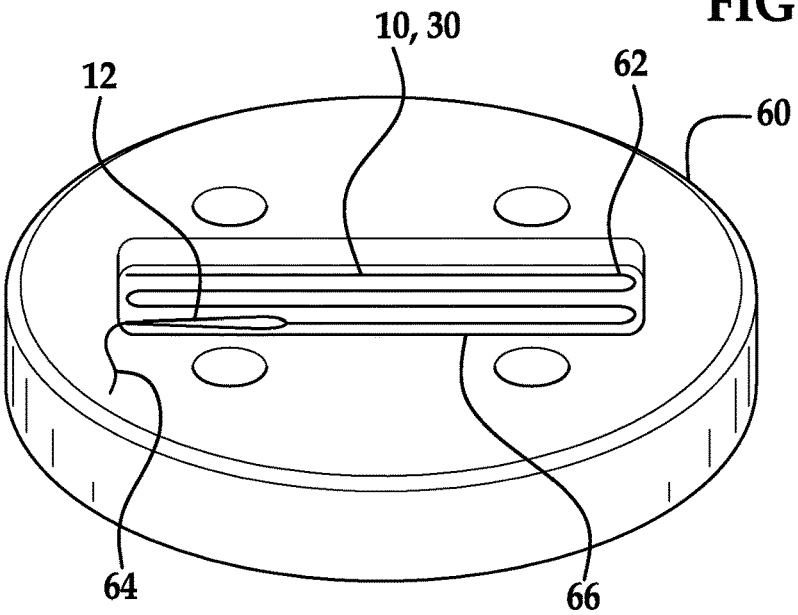
FIG. 6 is a bottom view of a replacement button with a slot shaped bottom face recess for retaining a multi-strand pre-attached needle or a dual needled multi-strand in accordance with embodiments of the invention.

FIG. 4 is a side view of a replacement button 40 retaining a multi-strand pre-attached needle of the sewing system 10 or 30 along a button side. The replacement button 40 may be attached to the fabric/garment or supplied with the fabric/garment. In the event a button detaches from the fabric/garment, the replacement button 40 configured with the sewing system 10 or 30 may be used to repair the fabric/garment. FIG. 5 is a bottom view of a replacement button 50 retaining a multi-strand pre-attached needle of the sewing system 10 or 30 on a button face of the button 50. FIG. 6 is a bottom view of a replacement button 60 with a slot shaped bottom face recess 62 for retaining a multi-strand pre-attached needle of the sewing system 10 or 30. In a specific embodiment a drawstring 64 held in place with glue may be used to extract the sewing system 10 or 30 from the button 60. In a specific embodiment the sewing system 10 or 30 may be held in the slot recess 62 with a peel away tape or adhesive film 66.

The design of multi-strand thread with a center section of loose strands sandwiched between woven ends used in the inventive sewing system may be extended to additional applications such as dental floss to improve cleaning effectiveness by providing an increased frictional surface area. Alternately, multiple strands woven lines could be used wherever single strand ropes, wires, cutting wires, steel cables, electric cables, fiber-optic cables are used to provide various currently unknown benefits.

The foregoing description is illustrative of particular embodiments of the invention, but is not meant to be a limitation upon the practice thereof. The following claims, including all equivalents thereof, are intended to define the scope of the invention.

The invention claimed is:

1. A sewing system for securing a button to fabric, said system comprising:

a first segment of woven threads formed of a polymer, a proximal end of said woven threads treated to create a sewing needle;

a middle segment of free thread strands extending from said first segment, said middle segment of unwoven thread strands transitioning from said woven threads of said first segment, where said unwoven thread strands are sized to be threaded through a series of button holes in said button and provides the appearance of separate multi-threads securing the button, while eliminating the need to make multiple passes through the button holes and the fabric for each individual unwoven strand of said middle segment; and a securement or free strands at a distal end of a third segment extending from said middle segment, said securement or said free strands for securing the button to the fabric, wherein said securement is one of: a knot of the threads, an adhesive, a solidified polymer bead, fused synthetic fibers, or a combination thereof.

2. The system of claim 1 wherein said first segment has a length of more than $1/32^{nd}$ of an inch.

3. The system of claim 1 wherein said middle segment terminates at a proximal end of said third segment of joined threads extending from said middle segment.

4. The system of claim 1 wherein said first segment and said third segment comprises a single or multi-strand thread of one to ten woven threads.

5. The system of claim 1 wherein said middle segment comprises a single or multi-strand thread of one to ten threads.

6. The system of claim 1 wherein said middle segment is at least one one-quarter inch in length.

7. The system of claim 1 wherein said sewing needle is straight or curved.

8. The system of claim 1 wherein said sewing needle is attached to said first segment by crimping, gluing, heat affixing, friction affixing, cinching, or standard threading and knotting.

9. The system of claim 1 further comprising a heat shrink wrap tubing used at said first segment woven to create a rigid area to be used as said sewing needle.

10. The system of claim 1 wherein said sewing needle is pre-threaded through said button.

11. The system of claim 1 wherein said sewing needle is deployed end to end to a second needle or a second securement, the system stored on a spool.

12. The system of claim 1 wherein said first segment and said third segment further comprises a single or multi-strand thread of one to ten woven threads, and said first segment and said third segment each have a length of at least one-quarter inch.

13. The system of claim 1 further comprising a second sewing needle is attached to a distal end of said third segment, said sewing needle and said being attached by crimping, gluing, heat affixing, friction affixing, cinching, or threading.

14. The system of claim 13 further comprising a heat shrink wrap tubing is used at said first segment and said third segment to create a rigid area to be used as said first sewing needle and said second sewing needle.

15. The system of claim 13 wherein said first segment and said third segment are heat treated to create said first sewing needle and said second sewing needle.

16. A sewing system for securing a button to fabric, said system comprising:

a sewing needle attached to a first segment of joined thread;

a middle segment of free thread strands extending from said first segment, said middle segment of unwoven thread strands are sized to be threaded through a series of button holes in said button and provides the appearance of separate multi-threads securing the button, while eliminating the need to make multiple passes through the button holes and the fabric for each individual unwoven strand of said middle segment; and a securement or free strands at a distal end of a third segment extending from said middle segment, said securement or said free strands for securing the button to the fabric, wherein the button is a replacement button, where the replacement button is attached or supplied with the fabric; and wherein the replacement button retains the sewing system on a button face recess or along a button edge of the replacement button.

17. A sewing system for securing a button to fabric, said system comprising:

a sewing needle attached to a first segment of joined thread;

a middle segment of free thread strands extending from said first segment, said middle segment of unwoven thread strands are sized to be threaded through a series of button holes in said button and provides the appearance of separate multi-threads securing the button, while eliminating the need to make multiple passes through the button holes and the fabric for each individual unwoven strand of said middle segment; and a securement or free strands at a distal end of a third segment extending from said middle segment, said securement or said free strands for securing the button to the fabric, wherein the button is a replacement button, where the replacement button is attached or supplied with the fabric; and wherein the replacement button is configured with a slot shaped bottom face recess for retaining the sewing system.

18. The system of claim 17 further comprising a drawstring held in place with glue, where the drawstring is used to extract the sewing system from the replacement button.

19. The system of claim 17 further comprising a peel away tape or adhesive film to contain the sewing system in the replacement button.

20. An article comprising:

fabric;

a button; and thread retaining said button in contact with said fabric, said thread comprising:

a first segment of woven threads formed of a polymer, a proximal end of said woven threads treated to create a sewing needle;

a middle segment of free thread strands extending from said first segment, said middle segment of unwoven thread strands transitioning from said woven threads of said first segment, where said unwoven thread strands are sized to be threaded through a series of button holes in said button and provides the appearance of separate multi-threads securing the button, while eliminating the need to make multiple passes through the button holes and the fabric for each individual unwoven strand of said middle segment; and a securement or free strands at a distal end of a third segment extending from said middle segment, said securement or said free strands for securing the button to the fabric, wherein said securement is one of: a knot of the threads, an adhesive, a solidified polymer bead, fused synthetic fibers, or a combination thereof.

21. A sewing kit comprising:

a plurality of buttons;

each of said plurality of buttons attached to a thread said thread comprising:

a first segment of woven threads formed of a polymer, a proximal end of said woven threads treated to create a sewing needle;

a middle segment of free thread strands extending from said first segment, said middle segment of unwoven thread strands transitioning from said woven threads of said first segment, where said unwoven thread strands are sized to be threaded through a series of button holes in said button and provides the appearance of separate multi-threads securing the button, while eliminating the need to make multiple passes through the button holes and the fabric for each individual unwoven strand of said middle segment; and a securement or free strands at a distal end of a third segment extending from said middle segment, said securement or said free strands for securing the button to the fabric, wherein said securement is one of: a knot of the threads, an adhesive, a solidified polymer bead, fused synthetic fibers, or a combination thereof.

22. The kit of claim 21 wherein each button of said plurality of buttons is attached to a thread of a different color.

* * * * *